US006206979B1

(12) United States Patent
Hiden et al.

(10) Patent No.: US 6,206,979 B1
(45) Date of Patent: Mar. 27, 2001

(54) PROCESS AND APPARATUS FOR TREATING A STRIP MATERIAL IN A LIQUID BATH

(75) Inventors: Günther Hiden, St. Stefan (AT); Peter Gravert, Wuppertal (DE)

(73) Assignee: Andritz-Patentverwaltungs-Gesellschaft m.b.H., Graz (AT)

( * ) Notice: Subject to any disclaimer, the term of this patent is extended or adjusted under 35 U.S.C. 154(b) by 0 days.

(21) Appl. No.: 09/197,660

(22) Filed: Nov. 23, 1998

(30) Foreign Application Priority Data

Nov. 28, 1997 (AT) ..... 2019/97

(51) Int. Cl.[7] ..... B08B 1/02

(52) U.S. Cl. ..... 134/15; 134/41; 134/64 R; 134/122 R

(58) Field of Search ..... 134/15, 41, 64 R, 134/122 R, 124, 131

(56) References Cited

U.S. PATENT DOCUMENTS

| | | | |
|---|---|---|---|
| 4,850,378 | 7/1989 | Mattiussi | 134/15 |
| 4,928,717 | 5/1990 | Osarek et al. | 134/64 R |
| 5,116,447 | 5/1992 | Kimura et al. | 156/345 |
| 5,282,485 | 2/1994 | Hirai et al. | 134/64 R |
| 5,454,388 * | 10/1995 | Glaiman et al. | 134/64 R |
| 5,634,481 | 6/1997 | Legoupil | 134/122 R |
| 5,716,455 * | 2/1998 | Zednicek et al. | 134/15 |

FOREIGN PATENT DOCUMENTS

WO 8805832 8/1988 (WO) .

* cited by examiner

*Primary Examiner*—Randy Gulakowski
*Assistant Examiner*—Saeed Chaudhry
(74) *Attorney, Agent, or Firm*—Roylance, Abrams, Berdo & Goodman, L.L.P.

(57) ABSTRACT

A process and apparatus for surface treatment of strip material with liquids, particularly for pickling rolled metal strip, guides the strip through the shallow treatment bath where the metal strip is treated. The treatment liquid medium is sprayed upwardly through nozzles between the bottom of the bath and the strip to be treated, causing a carrying and pulling effect which prevents the strip from contacting the bottom of the bath and prevents the strip from being lifted up from the bath. A plurality of spaced apart spray nozzles introduce a spray of liquid upwardly into the liquid bath to produce alternating high and low pressure zones causing the strip material to travel in an oscillating path.

21 Claims, 3 Drawing Sheets

PROCESS AND APPARATUS FOR TREATING A STRIP MATERIAL IN A LIQUID BATH

FIELD OF THE INVENTION

The present invention relates to a process and apparatus for guiding a strip material through a liquid bath. More particularly, the invention is directed to a process and apparatus for feeding a strip material through a shallow bath while supplying a liquid feed to the bath in a direction to prevent the strip from contacting the bottom of the bath.

BACKGROUND OF THE INVENTION

According to the state of the art, strip processing plants, such as those used for metal pickling plants, using liquid baths are designed with each individual bath measuring approximately 100 to 500 mm deep and normally 10 to approximately 40 m long. The reaction speed of the treatment medium on the surface of the strip material being processed is improved by reducing the liquid boundary or barrier layer on the strip surface. To reduce the thickness of the liquid boundary layer on the strip of material, the current trend is now towards the use of shallower liquid baths. The shallow bath depth produces greater bath turbulence due to the higher Reynolds number and a reduction in the thickness of the liquid boundary layer due to the increased shearing effect. The shallow bath depth also results in less sag of the strip material in the bath.

The required average depth of the bath is dependent, in part, on the speed of the strip material passing through the bath. Due to the dragging effect in the liquid produced by the moving strip, the liquid treatment medium is carried along in the treatment tank in the same direction as the advancing direction of the strip. This results in a slant or incline of the liquid surface level with a corresponding increase in the depth of the bath at the strip exit point and the equivalent reduction in the depth of the bath at the strip entry point. At higher speeds (e.g., above a strip speed of approximately 200 m/min with 200 mm mean depth and 20 m length of the bath), the liquid is carried away by suction from the strip entry point into the treatment bath such that the distance over which the strip is submerged in the treatment medium is shortened accordingly. This results in the length of the treatment bath and the tank not being fully utilized. As a result, the mean liquid level of the bath must be raised to avoid the strip entry area being emptied by the suction from the advancing strip. The optimum efficiency of a treatment bath with an open top surface is thus a compromise between the shortened bath length caused by the drag which reduces the pickling effect and the greater mean depth of the treating liquid bath.

Various treatment baths have been designed to eliminate the tensioning devices by providing shallow baths. One example of a bath having a structure to maintain a small mean bath depth at high speeds is by the use of a closed treatment channel. However, the level of the treatment liquid can be higher than the entry and exit points of the strip. The depth of the bath is thus limited by the height of the treatment channel. In order to prevent the liquid from being drawn or sucked out of the treatment channel, the strip exit point from the treatment channel must be sealed hydrodynamically against the back-up pressure caused by the dragging effect. An example of this type of structure and process is disclosed in, for example, EP 0 655 519 A1. The hydrodynamic seal requires a much higher energy input compared to the treatment baths with an open top surface. Furthermore, the high velocity and head pressure caused by sealing the bath at the strip exit point of the treatment channel makes it more difficult to provide the required supply of fresh treatment medium to the strip being treated. The closed channel requires more energy to feed the fresh liquid treatment medium into the channel.

In addition to the optimum contact and surface treatment of the strip of material with treating liquid, it is desirable to minimize the contact of the moving strip with the bottom of the trough. Contact of the strip with the bottom of the trough produces scratches and scrapes and causes smooth or worn areas on the strip, thereby reducing the quality of the finished strip material. Deep treatment baths allow the strip material to be run in catenarian curve without the strip contacting and dragging along the bottom of the trough. However, shallower baths which require at least some sag in the strip forming a catenarian curve result in the strip contacting the bottom of the trough, particularly when the strip is advanced at low speeds. The relation between the amount of the sag in the strip for a given tension and the length between the tension supporting rollers is not a reliable control of the sag to prevent contact with the bottom of the trough. Adjusting the tension of the strip material in the liquid bath can reduce some of the contact of the strip along the bottom, but generally cannot eliminate the contact entirely. Generally, slides, wedges or other support members are placed along the bottom of the trough to minimize contact of the strip with the bottom of the trough.

The feed mechanisms of the pickling treatment baths include various tensioning devices to control the amount of sagging in the strip of material being carried through the treatment baths. Depending on the material being treated and the depth of the bath, the tension of the strip can be adjusted to provide little or no sag.

Contact of the strip material with the bottom of the trough is, in part, dependent on the speed of the strip in the bath. At higher strip speeds, a hydrodynamic sliding film of the treatment liquid forms between the strip and the bottom wall of the trough or the slides and wedges in the bottom of the treatment bath, thereby preventing scrapes or smooth areas on the strip. At low strip speeds, however, the strip scrapes along the bottom wall or over the slides and wedges of the treatment bath such that the surface quality of the strip may be impaired and causing wear of the bottom of the bath or the slides and wedges.

Continuous strip treatment plants include equipment for welding together the individual strips to be treated, and thus, allowing them to be pulled through the treatment baths without a break. In a particular type of strip treatment plant, such as a push-type pickle bath according to EP 0 302 057 B1, suitable equipment pushes the strips through the treatment baths. The strip head is first gripped and then the complete strip pulled through the treatment bath. After the insert procedure, these plants are subject to the same conditions for the treatment bath as described above for continuous strip treatment plants. Unlike the continuous strip plants, however, there is no means of preventing the contact forces between the strip and the bottom wall of the bath. These plants do not provide a way to apply tension to the strip while the strip is being pushed in and pulled out because the strip head and tail are not secured. Thus, sufficient strip tension cannot be applied to minimize contact of the strip with the bottom wall of the trough. In addition, loops or folds can form when the strip is inserted. This looping is caused by friction between the strip and the bottom of the bath or by faulty strip head guidance. The plant operations then have to be halted and the strip reinserted into the treatment bath to resume the treatment of the strip.

SUMMARY OF THE INVENTION

The present invention is directed to a process and apparatus for improving the guidance of a strip of material through a shallow treatment bath. Accordingly, an object of the invention is to provide an apparatus to minimize contact of the strip with the bottom wall of the trough, particularly when the strip is conveyed at low speeds.

A further object of the invention is to provide a liquid treatment bath for strip materials that reduce the formation of loops, buckles and folds in the strip as compared to conventional push-type feed devices.

Another object of the invention is to provide an inlet in the bottom of a liquid treatment trough for directing a flow of the treating liquid upwardly toward the strip material being carried through the trough to prevent the strip from contacting the bottom of the trough when the strip is advanced at low speeds.

A further object of the invention is to provide a process and apparatus for treating a strip of material in a liquid bath in a manner such that the strip is positioned close to the bottom of the trough while substantially minimizing contact of the strip with the bottom of the trough when the strip is stationary or at low and high speeds.

Still another object of the invention is to provide a process and apparatus for treating a strip material in a liquid bath contained in a trough where the trough has a bottom wall formed of two inclined bottom panels converging toward a center of the trough to define a substantially V-shaped bottom which causes the strip to curve in a transverse direction with respect to the advancing direction of the strip.

A further object of the invention is to provide a pickling treatment bath having a bottom wall with at least two spaced apart communicating spray nozzles with unrestricted feed of a treatment liquid below the strip. The suction effect of these feeds in combination with the mechanical link by the strip causes the feed stream to shift from a first feed to the other communicating feed so that the strip oscillates along the longitudinal axis of the strip. It has been found to be advantageous to arrange the feeds transversely across the advancing direction of the strip a distance less than the width of the strip.

These and other objects of the invention are basically attained by providing a process for contacting a strip material with a liquid bath, comprising the steps of: feeding a strip material to a receiving end of a trough and directing the strip material to a discharge end of the trough, the trough including a bottom wall extending from the receiving end to the discharge end and having opposite side walls for defining a strip material contact zone in a bottom section of the trough, the trough containing a liquid bath in the contact zone; conveying the strip material through the contact zone and creating a current of the liquid through the contact zone from the receiving end to the discharge end of the trough; spraying a supply of the liquid in a substantially upward direction into the contact zone toward the strip material at a force sufficient to prevent the strip from contacting the bottom wall and without lifting the strip from the liquid bath independent of the advancing speed of the sheet material; and discharging the material strip from the discharge end of the trough.

The objects of the invention are further attained by providing an apparatus for immersing and treating a strip material in a liquid bath, the apparatus comprising: a trough having a longitudinal dimension with a bottom wall, first and second side walls, a strip material receiving end and a strip material discharge end, the trough being dimensioned to receive a treating liquid and contain a liquid bath; a feed device for continuously feeding the strip material from the receiving end to the discharge end through the trough, wherein the trough includes a strip material contact zone proximate the bottom wall; and at least one liquid spray nozzle in the bottom wall for injecting a spray of the liquid upwardly toward the strip material at sufficient force to prevent the strip from contacting the bottom wall and without lifting the strip from the liquid bath independent of the speed of the strip material through the liquid bath.

These and other objects, advantages and salient features of the invention will become apparent from the following detailed description of the invention and the drawings which disclose preferred and various objects of the invention.

BRIEF DESCRIPTION OF THE DRAWINGS

Referring to the drawings which form part of this original disclosure, in which.

DETAILED DESCRIPTION OF THE INVENTION

Figure 1:
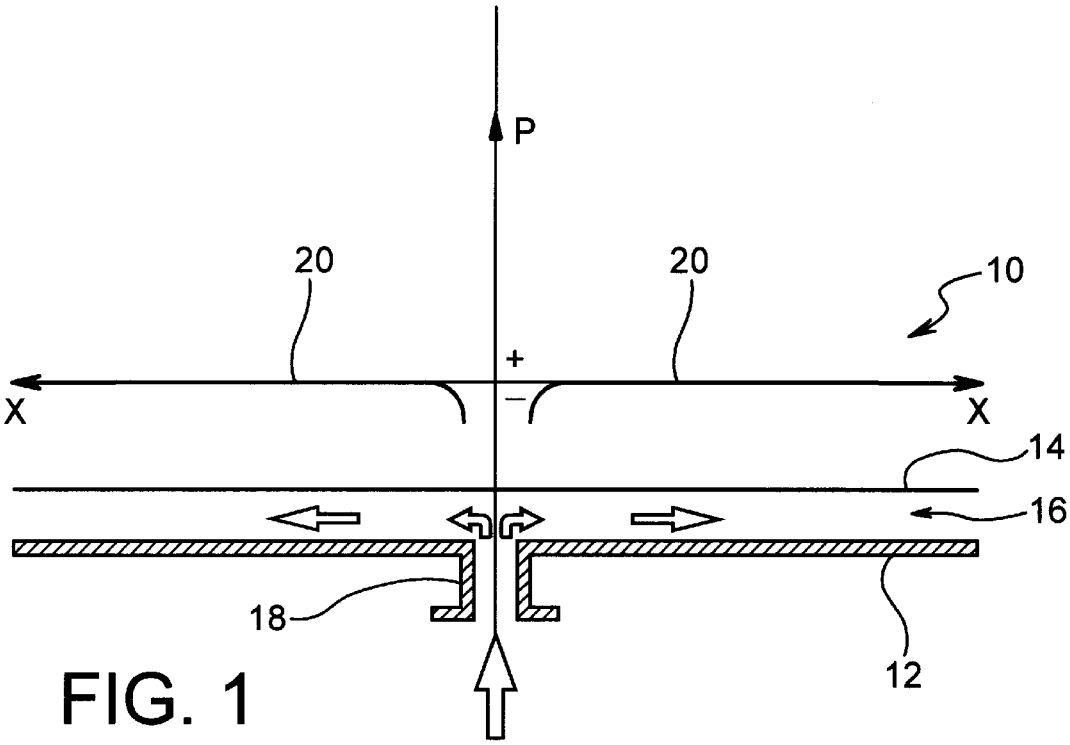
FIG. 1 is a schematic diagram of a liquid treatment. bath showing the pressure distribution from an injected treatment liquid when the gap between the strip and the bottom wall is large.

The present invention is directed to a process and apparatus for treating a continuous strip of material through a liquid treatment bath. The invention particularly relates to a process and apparatus for treating a metal sheet, such as steel, in an acid pickling bath. The pickling bath is generally a conventional hydrochloric acid or sulfuric acid solution as known in the art.

The process and apparatus of the present invention are particularly directed to treatment baths contained in a shallow trough where the strip is conveyed from feed rollers at the receiving end to discharge rollers positioned above the liquid level at the discharge end of the trough. The feed and discharge rollers and the tension of the strip between the rollers are controlled and provide sufficient slack or sag in the strip for immersing the strip in the liquid bath for substantially the entire working length of the trough. The trough is provided with an upwardly directed stream of the treating liquid to the bottom surface of the strip to minimize contact of the strip with the bottom of the trough independent of the advancing speed of the strip through the trough.

The purpose of the present invention is to improve strip guidance in the treatment plants with long, shallow treatment baths, in such a way as to avoid contact of the strip with the bottom of the bath at low speeds and reduce unreliability of operation caused by loops which form in push-type plants.

The invention is characterized by the treatment medium being sprayed into the bath through nozzles between the bottom of the bath and the strip to be treated, causing a carrying and pulling effect which alleviates contact by the strip on the bottom of the bath and prevents the strip from being lifted out of the bath. As a result, stationary, slow-running and also high-speed strips are retained close to the bottom of the treatment bath without contacting the bottom wall.

The factors determining the forces which act on the strip include the relation between the flow rate of the liquid and the friction of the fluid film between the strip and the bottom of the treatment bath in the vicinity of the liquid source. High flow rates under the strip cause low-pressure areas to form, and the resulting force component generated from the dead weight of the strip and the suction effect of the source current pulls the strip toward the bottom. The smaller the clearance between the strip and the bottom, the greater the liquid flow resistance, and thus, the higher the pressure underneath the strip, thereby causing a supporting effect for a particular gap height which prevents the strip from coming into contact with the tank bottom.

The clearance between the strip to be treated and the bottom of the bath is thus retained in a steady position by a balance between a negative pressure, a high pressure, and external forces acting on the strip. When the strip speed is increased, a current of liquid generated by the dragging effect of the strip is superimposed on the current produced by the introduction of the treatment liquid through the spray nozzles in the bottom of the bath, which produces a hydrodynamic effect causing the fluid to spread out over a large area and prevent the strip from contacting the bottom of the trough.

The advantages of the treatment bath of the invention are that even slight excess pressure of a few millibar is sufficient to compensate for the weight of the strip because the injected liquid contacts the entire surface of the underside of the strip. In addition, the injection of the liquid to the underside provides a supporting effect when the strip is stationary.

A further advantage of the invention is obtained by providing at least two liquid inlet flows to the underside of the strip to define a supporting cushion between the two inlets. In push-type strip treatment plants, in particular, the free buckling length of the strip is greatly reduced by the strip being retained hydrodynamically at several points in the strip running direction, thus reducing the risk of looping or folding.

In embodiments of the invention, a curve is formed across the strip in a transverse direction with respect to the running length of the strip. The bottom of the treatment bath trough is formed with a longitudinal V-shaped depression which causes the strip, particularly thin strips, to have a curved shape by the suction from the hydrodynamic effect. This curve increases the resistance of the strip to buckling and folding in the longitudinal direction.

A further development of the invention is characterized by at least two liquid feed inlets into the trough that are connected together by a common pipe and which allows treatment liquid to flow in freely through the inlets into the bath underneath the strip. The suction effect of the liquid inlets combined with the mechanical link through the strip alternately displaces the outlet flow from one inlet to the other connected source, thus forming a system that is able to oscillate. The resulting violent strip oscillation has an advantageous effect in reducing the barrier layer next to the strip. It has proved favorable for producing the strip oscillating movement to arrange the liquid sources at right-angles to the strip running direction, one next to the other and with spacing smaller than the strip width.

Figure 2:
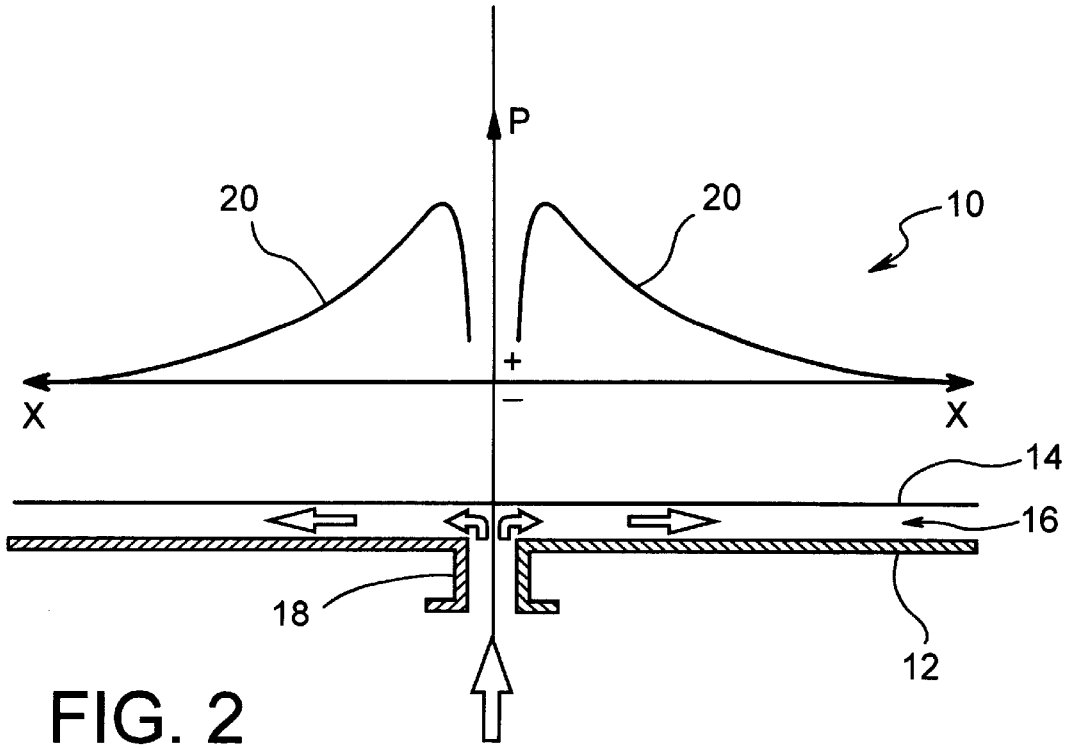
FIG. 2 is a schematic diagram of a liquid treatment bath showing the pressure distribution from an injected treatment liquid when the gap between the strip and the bottom wall is small.

The process and apparatus of the invention provide an arrangement for guiding a strip material through a liquid bath in a manner to minimize contact of the strip with the bottom of the tank and to prevent buckling of the strip as it is carried through the liquid bath. Drawing a strip material through a liquid bath produces currents in the bath and a low pressure zone between the strip material and the bottom of the trough containing the liquid bath. FIGS. 1 and 2 illustrate the dependence of the pressure between the strip and the bottom wall of the trough on the spacing between the strip and the bottom wall. Referring to FIG. 1, a treating apparatus 10 having a trough with a bottom wall 12 contains a treating liquid. A strip material being treated 14 is passed through the liquid in a manner to provide a large gap 16 between the sheet material 14 and the bottom wall 12. An injection opening 18 is provided in the bottom wall 12 of the trough to inject a flow of the treating liquid upwardly against the bottom surface of the strip of sheet material 14. The curve 20 shows that when a large gap is provided between the strip material and the bottom of the trough, the fluid pressure on the bottom surface of the sheet material is substantially uniform.

As shown in FIG. 2, a small gap 16 between the sheet material 14 and the bottom 12 of the trough provides a greater flow resistance of the liquid between the strip material and the bottom of the trough. The flow resistance results in a greater pressure between the sheet material and the bottom of the trough when the liquid is injected upwardly through the nozzle 18. As shown by curve 20 in FIG. 2, a high pressure zone is formed around the inlet nozzle 18 and gradually lowers as the liquid flows away from the nozzle.

Figure 3:
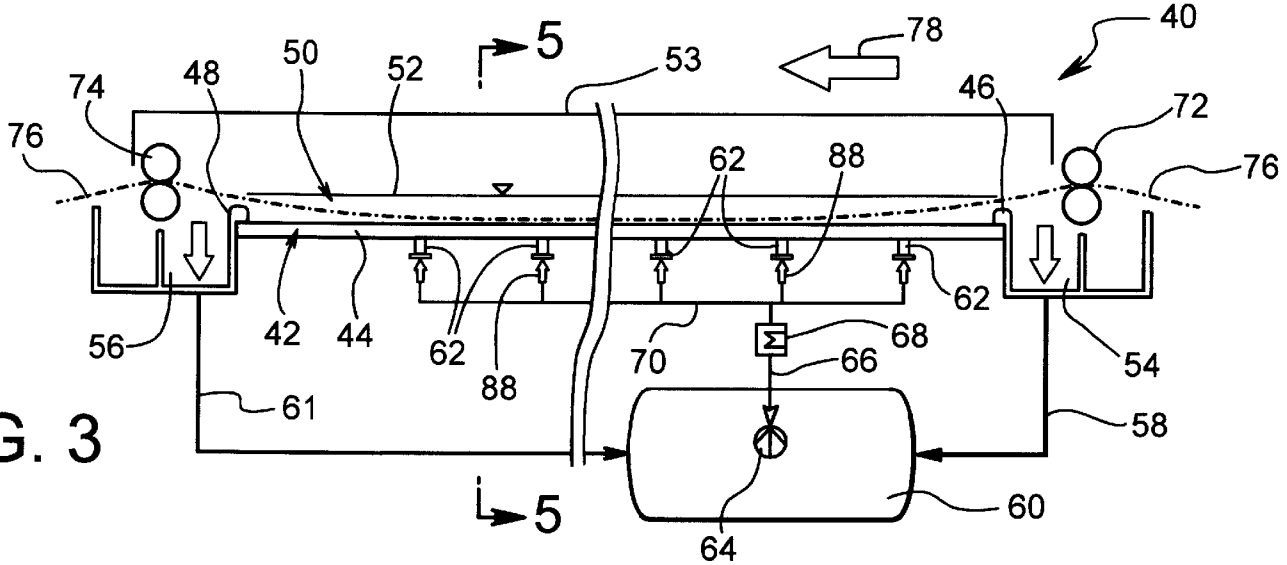
FIG. 3 is a cross-sectional side view of a liquid treatment bath in a preferred embodiment of the invention.
Figure 4:
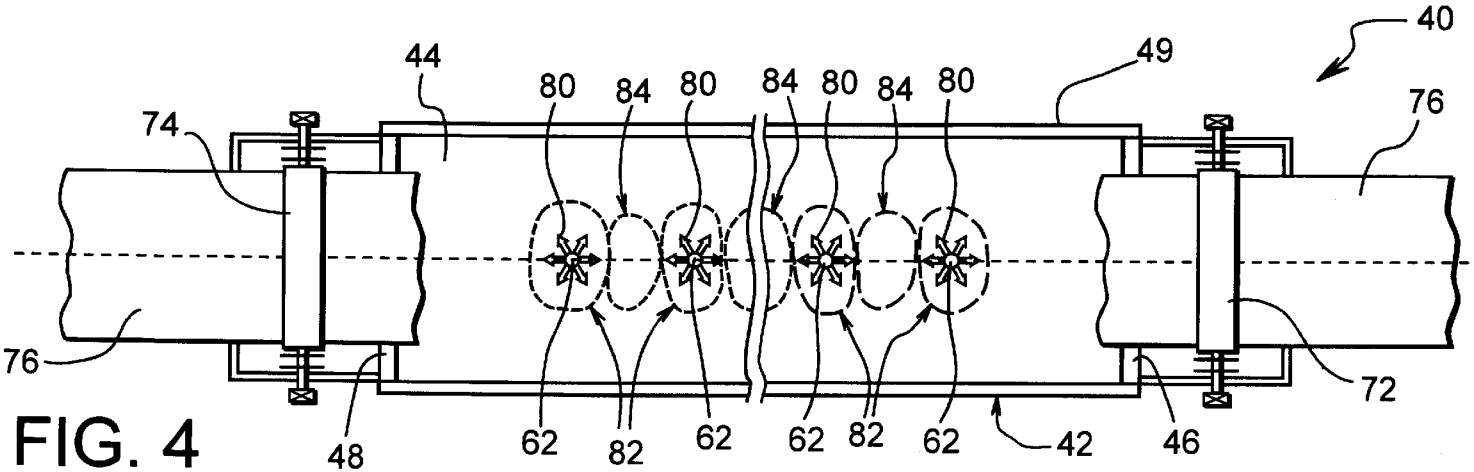
FIG. 4 is a top view of the liquid treatment bath of FIG. 3.
Figure 5:
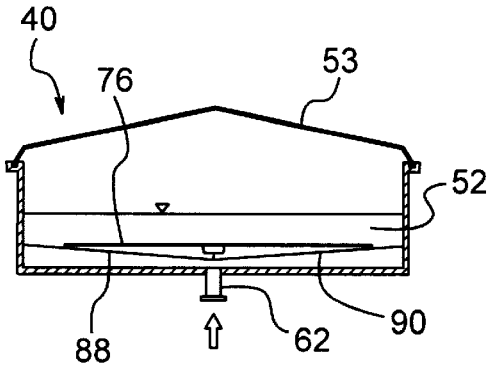
FIG. 5 is an end view in cross-section of the treatment bath of FIG. 3 taken along line V—V.

Referring to FIGS. 3–5, a liquid treatment apparatus 40 includes a trough 42 having a bottom wall 44. A front wall 46, a back wall 48 and side walls 49 define a liquid containment area 50 containing the treating liquid bath 52. A cover 53 is provided to contain the acid vapors in the apparatus 40. In preferred embodiments of the invention, the treating liquid is a pickling acid as known in the art. An inlet box 54 is provided adjacent the front wall 46 to receive the pickling acid overflowing from the containment area 50. In a similar manner, an outlet box 56 is provided adjacent the back wall 48 to receive the pickling acid overflowing from the containment area. A conduit 58 carries the pickling acid from the inlet box 54 to a storage tank 60. A conduit 61 carries the pickling acid from the outlet box 56 to the storage tank 60.

In preferred embodiments of the invention, a plurality of injection spray nozzles are provided in the bottom wall 44 to define liquid feed inlets to direct a flow of the treating liquid into the containment area 50. In the embodiment of FIGS. 3 and 4, the injection spray nozzles 62 are positioned substantially in the center of the trough and are positioned in a line extending in the longitudinal direction of the trough and the feed direction of the sheet material being treated. The injection spray nozzles are preferably positioned to direct a stream of the treating liquid upwardly in a substantially perpendicular direction with respect to the bottom wall 42 of the trough. The nozzles 62 are spray nozzles to cause the liquid to spread outwardly in all directions in a generally upward direction. The nozzles can be conventional spray nozzles that are capable of providing a spray pattern of 360° with respect to the center axis of the nozzle within the liquid bath to form a supporting cushion in the bath. Preferably, the nozzles spray the liquid in a wide pattern and at a rate sufficient to form a supporting cushion across the width of the strip material.

A pump 64 carries the pickling acid from the tank 60 through a line 66 to an optional heat exchanger 68. A suitable purification, acid regeneration or fresh acid supply can be included in the pickling acid stream. The pickling acid is then carried through a pipe manifold system 70 to supply the pickling acid to each of the injection spray nozzles 62. As shown in FIG. 3, each of the nozzles 62 are in communication with each other by the pipe manifold 70 such that liquid is able to flow freely from the manifold to each nozzle.

A pair of opposing feed rollers 72, such as nip rollers, are positioned in the upper end of the inlet box 54. A pair of receiving rollers 74, which can also be nip rollers, are positioned in the outlet box 56. Preferably, the feed rollers 72 and the outlet rollers 74 are positioned above the level of the pickling acid 52 contained within the inlet box 54, the outlet box 56 and the containment area 50. A strip of material 76, such as a strip of metal, is fed in the direction of arrow 78 from the feed roller 72 to the outlet roller 74. The speed of the rollers 72 and 74 are selected to feed the metal strip 76 through the pickling acid bath to provide the desired retention time in the bath.

The rollers 72 and 74 are adjusted to provide a predetermined amount of slack or sag in the strip material 76 between the rollers to enable the strip material to contact the liquid bath. Preferably, the amount of sag in the strip material 76 is provided to enable the strip material 76 to enter the liquid bath 52 proximate to the front wall 46. Generally, it is desirable to feed the strip material 76 into the liquid bath 52 as close to the front wall 46 as possible without contacting the front wall to prevent scraping or scratching the strip material 76. In a similar manner, the slack provided in the strip material is such that the strip material is withdrawn from the liquid bath adjacent the back wall 48 as close as possible without contacting the wall 48. At high feed rates of the strip material 76, the drag on the liquid in the bath caused by the advancing movement of the strip material forms a liquid cushion between the strip material and the bottom 42 of the trough which minimizes contact of the strip with the bottom of the trough.

Referring to FIG. 4, the pickling acid is injected into the trough 42 upwardly through the injection spray nozzles 62 against the bottom surface of the strip material 76. At slow speeds, the strip material produces insufficient drag on the pickling acid in the trough to form a supporting layer of liquid between the strip material and the bottom wall 42. An absence of the supporting liquid layer and the weight of the strip material causes the strip material to pass closer to the bottom wall 42 at lower speeds than at higher speeds. Typically, at slow strip material speeds, the weight of the strip material causes sufficient sag such that the strip contacts the bottom wall of the trough. The pickling acid is sprayed upwardly through the spray nozzles 62 to provide a supporting cushion for the strip material to prevent the strip material from contacting the bottom wall 44 of the trough.

In the embodiment of FIG. 4, the injection spray nozzles 62 are spaced apart in a longitudinal direction with respect to the advancing direction of the strip material 76. The spray nozzles 62 spray the liquid in a generally upward and outward direction as shown by arrows 80 to form a zone of high pressure fluid 82 between the adjacent injection nozzles 62. The flow rate of the pickling acid through the injection spray nozzles 62 in embodiments can be selectively adjusted according to the advancing speed of the strip material 76 such that at lower speeds, a higher flow rate through spray nozzles 62 is provided to prevent the strip material from contacting the bottom wall 44 of the trough. The flow rate of the pickling acid through the spray nozzles 62 is generally sufficient to form a supporting cushion of liquid below the strip material in the zone 82 without pushing the strip material upwardly out of the pickling bath and without buckling the strip material.

The advance of the strip material 76 through the liquid bath draws the liquid from the gap between the bottom surface of the strip material and the bottom wall of the trough, thereby lowering the pressure in the gap. The advancing speed, the amount of sag and weight of the strip are balanced by the pressure produced by spraying the liquid upwardly through the spray nozzles to position the strip material at a selected distance from the bottom wall. By controlling the flow rate of the liquid through the nozzles 62, the spacing between the strip material and the bottom wall can be maintained constant independent of the weight, speed and sag of the strip material.

The injection spray nozzles 62 are preferably spaced apart a distance less than the width of the strip material being treated. The advance of the strip material 76 creates a drag in the liquid bath 52 and produces low pressure zones 84 relative to the high pressure zone 82 and spaced between the high pressure zones 82. The alternating zones of high and lower pressure 82, 84 in the bath produce an oscillating effect of the strip material.

In alternative embodiments of the invention, the injection spray nozzles 62 can be controlled by control valves 88 which are connected to a control unit (not shown). The control unit can actuate each of the control valve individually to control the flow of the pickling acid through the respective injection spray nozzle 62. The control device actuates the control valves in a manner to provide a continuous and uniform flow of the pickling acid through the injection spray nozzles to provide a substantially uniform flow and pressure of the pickling acid in selected locations around the nozzles in the trough. By selectively controlling flow rates of the pickling acid through each injection nozzle, the strip material can assume an oscillating path through the pickling bath. In alternative embodiments, the flow rate of the pickling acid through adjacent injection nozzles can be different to create a high pressure zone adjacent a lower pressure zone in the bath.

Figure 4A:
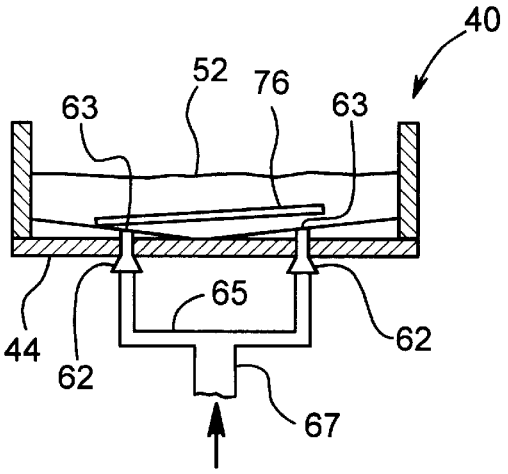
FIG. 4A is a cross-sectional end view of the trough showing a pair of side-by-side inlets in the bottom wall with the strip tilting in a first direction.
Figure 4B:
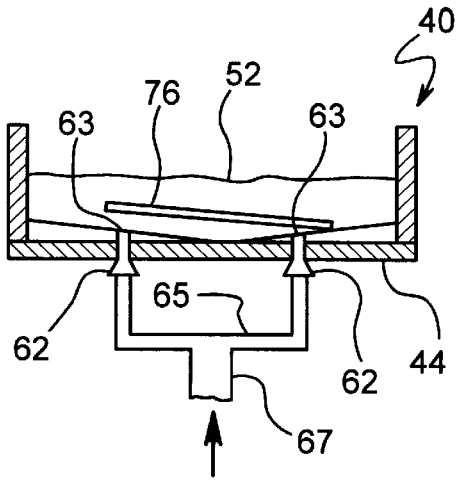
FIG. 4B is a cross-sectional end view of the trough of FIG. 4A showing the strip tilting in a second direction.

In a further embodiment of the invention shown in FIGS. 4A and 4B, at least two liquid inlets 63 are provided in the bottom wall 44 of the trough 40. The inlets 63 are spaced apart in a direction transverse to the advancing direction of the strip material 76 and transverse to a longitudinal dimension of the trough 40. In FIGS. 4A and 4B, two side-by-side inlets 63 are shown in the cross-section of the trough 40. In preferred embodiments, a plurality of the inlets 63 are positioned along the length of the trough as shown in FIG. 3.

As shown in FIGS. 4A and 4B, the inlets 63 include a spray nozzle 62 as in the previous embodiments which are connected to a common feed conduit 65. A liquid supply conduit 67 is connected to the feed conduit to provide a supply of the treating liquid. In the embodiment shown, the liquid from the supply conduit 67 to the feed conduit 65 is able to flow unrestricted to each of the inlets 63. The common feed conduit 65 enables the liquid flow to diverge from one liquid inlet 63 to the other when a restriction occurs in one of the inlets 63.

Referring to FIG. 4A, the advancing speed of the strip 76 through the trough 40 produces a drag on the liquid between the strip 76 and the bottom wall 44. As the strip 76 is pulled closer to the bottom wall, the strip 76 causes a resistance to liquid flow to one of the inlets 63 shown on the left of FIG. 4A which directs the liquid flow to the other inlet 63 shown on the right of FIG. 4A. The common feed conduit 65 causes the strip to be pulled toward the bottom wall 44 along one edge and lifted upwardly along the opposite edge. As the strip 76 tilts along its longitudinal axis, the lower edge creates a greater drag on the resulting thin layer of the liquid which increases the flow of liquid through the inlet on the left of FIG. 4A and a corresponding decrease in liquid flow through the inlet on the right of FIG. 4A. This causes a shift in the direction of tilt of the strip 76 as shown in FIG. 4B. The strip continues to oscillate along its longitudinal axis between the positions shown in FIGS. 4A and 4B with a corresponding shift in liquid flow through the inlets 63. This oscillating movement of the strip agitates the liquid to provide uniform treatment.

Figure 5A:
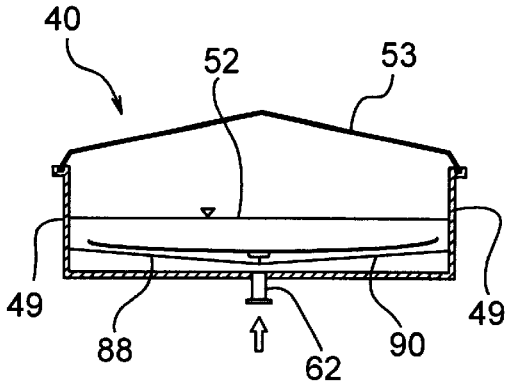
FIG. 5A is an end view of the treatment bath showing the curved shape of the strip material.

Referring to FIG. 5, the bottom wall 42 of the trough preferably has inclined bottom surfaces 88 and 90 converging from the side walls 49 toward the center of the trough to form a substantially V-shape depression in the bottom wall extending in a longitudinal direction with respect to the advancing direction of the strip material. The advancing speed of the sheet material 76 being carried through the pickling acid produces a drag on the pickling acid and a low pressure zone between the bottom of the sheet material 76 and the trough. The sheet material 76 can be formed from a thin flexible material which is drawn toward the bottom of the V-shaped trough so that the sheet material 76 assumes a curved U-shape extending in the transverse direction of the sheet material as shown in FIG. 5A. The transverse curve in the sheet material extends through the longitudinal dimension of the trough and reduces the incidence of the sheet material from buckling or folding as the sheet material is being carried through the pickling bath.

Figure 6:
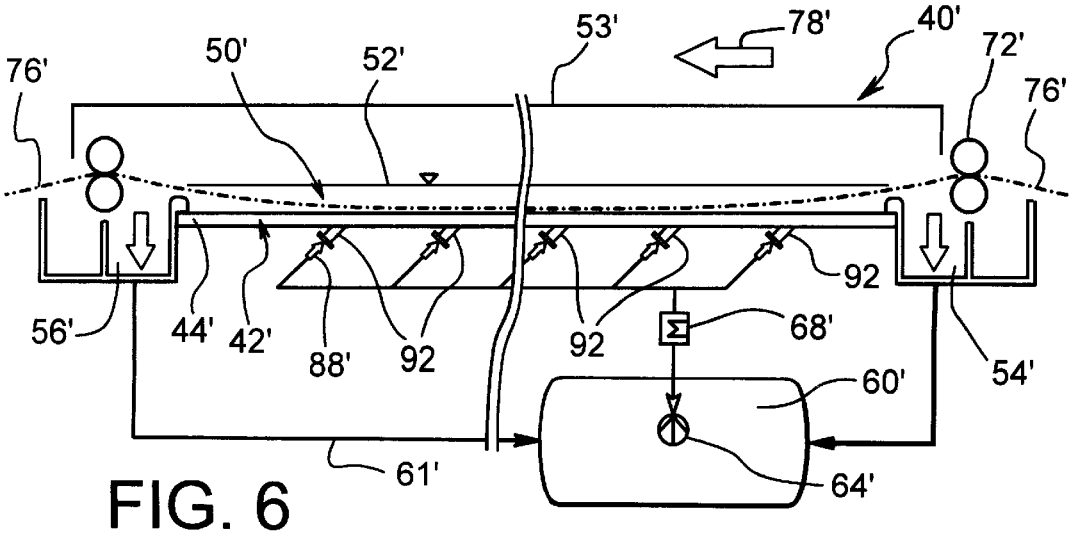
FIG. 6 is a side view in cross-section of a liquid treatment bath in a second embodiment of the invention.

In a further embodiment of the invention shown in FIG. 6, the apparatus is similar to the apparatus of the embodiment of FIG. 3 except for the injection nozzles 92. Therefore, identical components are identified by the same reference numbers with the addition of a prime. As shown in FIG. 6, a plurality of injection spray nozzles are provided in the bottom wall of the trough and are positioned at an incline with respect to the longitudinal axis of the trough. The nozzles 92 produce a spray pattern similar to the nozzles in the previous embodiment of FIGS. 3 and 4 to direct the spray and form a supporting liquid cushion against the direction of movement of the strip material.

In the embodiment of FIG. 6, the injection spray nozzles 92 are spaced along the longitudinal center axis of the trough and positioned to direct the flow of the pickling acid at an angle against the advancing direction of the sheet material 76'. Directing the flow of the pickling acid against the advancing direction of the sheet material 76' reduces the drag caused by the advancing sheet material drawing the pickling acid from the space between the sheet material and the bottom wall of the trough. In further embodiments, injection spray nozzles can be positioned above the sheet material being treated to spray a downwardly directed flow of pickling acid onto the sheet material to provide uniform treatment on both sides of the sheet material. Nozzles positioned above the sheet material are preferably spaced apart from each other and provided with suitable valve controls to adjust the flow of the pickling acid to each of the nozzles. The flow of the pickling acid to the nozzles can be controlled to produce an oscillating path for the sheet material through the bath in a similar manner as previously discussed. The nozzles can be positioned above the liquid treatment bath or below the surface of the liquid treatment bath.

While various embodiments have been selected to illustrate the invention, it will be understood by those skilled in the art that various changes and modifications can be made to the process and apparatus without departing from the scope of the invention as defined in the appended claims.

What is claimed is:

1. A process for contacting a strip material with a liquid bath, comprising the steps of feeding a strip material to a receiving end of a trough and directing said strip material to a discharge end of the trough, said trough including a bottom wall extending from said receiving end to said discharge end and having opposite side walls for defining a strip material contact zone in a bottom section of said trough, said trough containing a liquid bath in said contact zone, and having a plurality of liquid spray nozzles spaced apart in a direction between said receiving end and discharge end;

conveying said strip material through said contact zone and creating a current of said liquid through said contact zone from said receiving end to said discharge end of said trough;

spraying a supply of said liquid through each of said nozzles in a substantially upward direction into said contact zone toward said strip material at a force sufficient to prevent said strip from contacting said bottom wall and without lifting said strip from said liquid bath independent of the advancing speed of the sheet material, said liquid being sprayed through said nozzles into said contact zone at a pressure to produce a plurality of alternating high and low pressure zones between said strip material and said bottom wall; and discharging said material strip from said discharge end of said trough.

2. The process of claim 1, wherein said trough includes at least two treatment liquid spray nozzles in said bottom wall and spaced apart in a transverse direction of said strip material feed, and wherein said spray nozzles are connected together by a common supply conduit, said process further comprising supplying said liquid to said supply conduit and injecting said liquid through said spray nozzles at a pressure to form a cushion for supporting said strip in said trough.

3. The process of claim 2, further comprising injecting said liquid through said spray nozzles in said bottom wall at a pressure sufficient to cause said strip to travel in an oscillating path.

4. The process of claim 1, wherein said bottom wall includes first and second inclined bottom panels extending substantially the length of said trough and said bottom panels converging toward a center of said trough to form a substantially V-shaped bottom, said process further comprising conveying said strip material at a speed where said strip material has a curved shape in a transverse direction.

5. The process of claim 1, further comprising injecting said liquid in a direction substantially perpendicular to a direction of travel of said strip material.

6. The process of claim 1, wherein said strip material is fed to said trough from a feed roller positioned above said liquid bath at said receiving end to a discharge roller at said discharge end above said liquid bath with said strip material draped between said feed and discharge rollers an amount to contact said liquid bath.

7. The process of claim 1, wherein said spray nozzles are spaced apart a distance less than a width of said strip material.

8. The process of claim 1, wherein said process comprises injecting said liquid at an incline and in a countercurrent direction against a direction of travel of said strip material.

9. The process of claim 1, further comprising injecting said liquid toward a center of said strip.

10. The method of claim 1, further comprising adjusting said supply of said liquid through said nozzles in response to changes in an advancing speed of said strip material.

11. The method of claim 1, comprising spraying said liquid through said nozzles and producing a liquid cushion sufficient to support said strip and prevent said strip from contacting said bottom wall when said strip is stopped.

12. An apparatus for immersing and treating a strip material in a liquid bath, the apparatus comprising:

a trough having a longitudinal dimension with a bottom wall, first and second side walls, a strip material receiving end and a strip material discharge end, said trough being dimensioned to receive a treating liquid and contain a liquid bath;

a feed device for continuously feeding said strip material from said receiving end to said discharge end through said trough, wherein said trough includes a strip material contact zone proximate said bottom wall; and at least two liquid spray nozzles in said bottom wall spaced apart along a direction of travel of said strip material, and a liquid supply device for supplying liquid to said nozzles for injecting a spray of said liquid upwardly toward said strip material at sufficient force to form a supporting liquid cushion between said nozzles and to prevent said strip from contacting said bottom wall and without lifting said strip from said liquid bath independent of the speed of said strip material through said liquid bath.

13. The apparatus of claim 12, wherein said bottom wall of said trough has a substantially V-shaped cross-section having bottom panels converging toward a center of said trough.

14. The apparatus of claim 12, wherein said at least two spray nozzles are positioned in a longitudinal direction with respect to a feed direction of said strip and being spaced apart a distance less than a width of said strip.

15. The apparatus of claim 12, wherein said spray nozzles are positioned to direct said liquid in a direction substantially perpendicular to said strip material.

16. The apparatus of claim 12, wherein said spray nozzles are positioned to direct said liquid in a diagonal direction against the direction of travel of said strip material.

17. The apparatus of claim 12, further comprising at least two spray nozzles in said bottom wall and being spaced apart in a transverse direction with respect to a direction of travel of said strip material, and a common supply conduit connected to each of said spray nozzles for injecting said liquid through said spray nozzles into said trough in a direction against said strip material, wherein said feed of said strip and said supply conduit supplying said liquid to said nozzles, produce alternating high pressure and low pressure zones and produce an oscillating movement of said strip.

18. The apparatus of claim 17, wherein said nozzles are positioned to produce an oscillating movement of said strip along a longitudinal center axis of said strip.

19. The apparatus of claim 12, said feed device further comprising a feed roller at said receiving end and positioned above said liquid bath and a discharge roller at said discharge end and positioned above said liquid bath wherein said strip material is draped between said rollers to provide sufficient sag for said strip material to be immersed in said liquid bath.

20. The apparatus of claim 12, wherein said nozzles are spaced apart a distance to produce a plurality of alternating high and lower pressure zones along said bottom wall between said receiving end and said discharge end.

21. The apparatus of claim 20, wherein said nozzles are spaced apart a distance to produce a supporting cushion and prevent said strip from contacting said bottom wall when said strip is stopped.

* * * * *